United States Patent [19]

Winkler

[11] 3,974,384

[45] Aug. 10, 1976

[54] X-RAY DIAGNOSTIC APPARATUS FOR RADIOSCOPY AND X-RAY FILM EXPOSURES INCLUDING AN X-RAY TUBE HAVING A ROTATING ANODE

[75] Inventor: Hans-Werner Winkler, Buckenhof, Germany

[73] Assignee: Siemens Aktiengesellschaft, Erlangen, Germany

[22] Filed: Oct. 22, 1974

[21] Appl. No.: 517,067

[30] Foreign Application Priority Data

Nov. 12, 1973 Germany ..... 2356459

[52] U.S. Cl. ..... 250/401; 250/322; 250/406

[51] Int. Cl.[2] ..... H05G 1/26

[58] Field of Search ..... 250/409, 401, 406, 322

[56] References Cited

UNITED STATES PATENTS

| | | | |
|---|---|---|---|
| 2,092,618 | 9/1937 | Bowers | 250/406 |
| 2,185,826 | 1/1940 | Atlee | 313/60 X |
| 3,518,434 | 6/1970 | Lombardo | 250/406 |
| 3,564,254 | 2/1971 | Siedband | 250/406 |

*Primary Examiner*—Harold A. Dixon
*Attorney, Agent, or Firm*—Haseltine, Lake & Waters

[57] ABSTRACT

An X-ray diagnostic apparatus employed in radioscopy and for X-ray film exposures, including an X-ray tube with a rotating anode, in which the transitional time during changes in operational mode is completely eliminated. A circuit arrangement is included in the X-ray diagnostic apparatus in which each exposure upon actuation of an exposure triggering element immediately follows the preceding radioscopic operation, and wherein a signal corresponding to the actual value of the anode rotational speed is transmitted to a power output adjusting element, the power adjusting element being programmed in conformance with the permissible cycle of the X-ray tube power output in dependence upon the anode rotational speed, and to thereby effect the setting of the X-ray tube power output associated with the respective anode rotational speed.

3 Claims, 8 Drawing Figures

X-RAY DIAGNOSTIC APPARATUS FOR RADIOSCOPY AND X-RAY FILM EXPOSURES INCLUDING AN X-RAY TUBE HAVING A ROTATING ANODE

FIELD OF THE INVENTION

The present invention relates to an X-ray diagnostic apparatus employed in radioscopy and for X-ray film exposures, including an X-ray tube with a rotating anode.

DISCUSSION OF THE PRIOR ART

In known X-ray diagnostic apparatus employed in radioscopy and for film exposures, with a rotating anode X-ray tube, which includes a power output regulating element for increasing the X-ray tube output upon transition from radioscopic operation to film exposures, radioscopy is carried out at a reduced power output in contrast with the film exposure output, and with a stationary or slowly rotating anode (16⅔ Hz). If transition is to be effected from radioscopic operation to an exposure, the rotating anode is drawn upon and the X-ray tube power output is increased. The triggering of a film exposure is only effected when, subsequent to actuation of a drive motor for the rotating anode, the rotating anode has attained its maximum rotational speed. This time may be relatively long when employing high power X-ray tubes having high rotational speeds for the anodes. The time lies in the range of between 0.8 and 1.1 seconds.

In actual practice, it is desirable to be able to transfer from a radioscopic operation or examination to an exposure as rapidly as possible, meaning, that the transition time should be maintained as short as possible so that, for example, in producing target exposures, the desired target is still present. In the known X-ray diagnostic apparatus, the transition time is essentially determined by the dimensioning of the rotating anode drive motor, so that any reduction has limitations set thereon due to the size of the rotating anode drive motor.

It may also be mentioned that, in the known X-ray diagnostic apparatus, an exposure may only be triggered when there has been reached the desired filament current for the X-ray tube, so that for initiation of an exposure there immediately sets in the adjusted X-ray tube current.

In order to reduce the transition time between radioscopic operation and a film exposure, it has been previously proposed in earlier German Pat. Application P 22 35 252.9, to trigger an exposure during high speed running of the rotating anode, when the lowest anode rotational speed, at which the exposure current of the X-ray tube is available and the desired filament current of the X-ray tube have been reached. In the earlier proposal there is effectively achieved a reduction in the transition time in contrast with the state of the technology.

SUMMARY OF THE INVENTION

Accordingly, it is an object of the present invention to provide an X-ray diagnostic apparatus of the type described hereinabove, in which the transitional time during changes in operational mode is completely eliminated.

The foregoing object is inventively achieved through a circuit arrangement for the X-ray diagnostic apparatus in that each exposure upon actuation of an exposure triggering element immediately follows the preceding radioscopic operation, and wherein a signal corresponding to the actual value of the anode rotational speed is transmitted to a power output adjusting element, the power adjusting element being programmed in conformance with the permissible cycle of the X-ray tube power output in dependence upon the anode rotational speed, and to thereby effect the setting of the X-ray tube power output associated with the respective anode rotational speed. The invention employs the basic knowledge that immediate transition may be effected from radioscopic operation to a film exposure when the X-ray tube power output is continually increased in conformance with the cycle or sequence of the speed of rotation of the anode. In the inventive X-ray diagnostic apparatus there is encountered an increase in the exposure time as contrasted to the state of the technology, however, in contrast therewith there may, for example, immediately follow a targeting exposure, which affords the advantage of better encompassing the target. Furthermore, due to the continual acceleration of the X-ray tube power output, there is obtained a more protective tube loading during an exposure. No exposures are carried out with maximum load acting on the cold anode disc.

In an advantageous embodiment, the invention further provides for that the power output adjusting element include a calculator which, from signals corresponding to the actual values of the X-ray tube voltage and the anode rotational speed, indicates and adjusts the respectively permissible X-ray tube current. This renders possible that an exposure may be made with such an X-ray tube voltage, which has also been employed for the preceding radioscopic operation or examination.

BRIEF DESCRIPTION OF THE DRAWINGS

Reference may now be had to the following detailed description of an embodiment of the invention, taken in conjunction with the accompanying drawings; in which.

DETAILED DESCRIPTION

Figure 1:
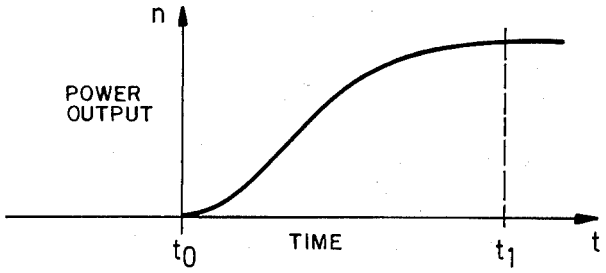
FIG. 1 graphically illustrates the cycle of anode rotational speed of a rotating anode X-ray tube in dependence upon time, during anode acceleration.

In FIGS. 1 through 4, the timepoint for initiating the triggering of an exposure is indicated by $t0$. $t1$ signifies the timepoint at which the rotating anode has approximately reached its reference speed of rotation after acceleration. The sequence or cycle of the anode rotational speed between timepoints $t0$ and $t1$ is illustrated in FIG. 1.

Figure 2:
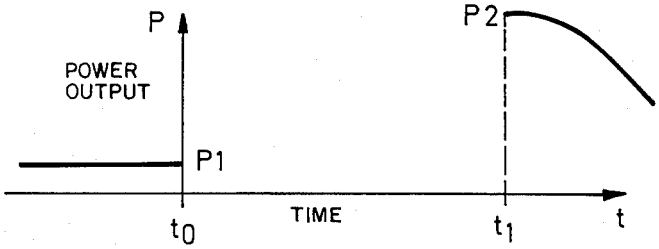
FIG. 2 graphically illustrates the time cycle of the X-ray tube power output in the known X-ray diagnostic apparatus of a type according to the present invention.

From FIG. 2 there is ascertainable that, in the known X-ray diagnostic apparatus, the X-ray tube power output prior to time $t0$, meaning, during radioscopic operation, has a lower value P1, and that at timepoint *t*0 the X-ray tube is completely deactivated. Only after reaching the highest rotational speed of the rotating anode at timepoint *t*1, is there introduced the high power P2 to the X-ray tube for the exposure. The FIG. 2 illustrates the basis for an exposure with dropping load, in which the X-ray tube power output in conformance with the respectively highest permissible value at timepoint *t*1 continually drops off until completion of the exposure. The rate of drop off can thereby also follow in conformance with a particular percentage portion of the highest permissible power output.

Figure 3:
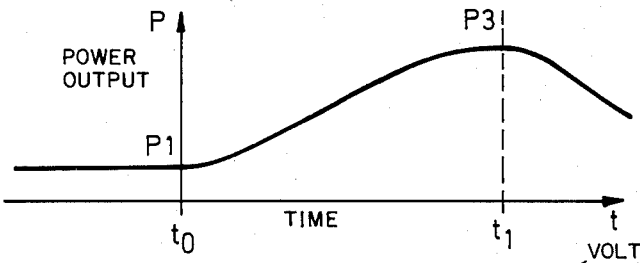
FIG. 3 grahically illustrates the time cycle of the X-ray tube power output in an X-ray diagnostic apparatus, pursuant to the invention.

The time interval between *t*0 and *t*1, as has been previously mentioned, in the known X-ray diagnostic apparatus lies approximately between 0.8 and 1.1 seconds. After actuation of the exposure triggering element there passes this time span, until the exposure is triggered. In contrast therewith, in the inventive X-ray diagnostic apparatus the exposure immediately follows the preceding radioscopic operation. This is illustrated in FIG. 3 of the drawings. FIG. 3 basically indicates that also herein the radioscopic operation is undertaken with the power P1 until timepoint t0. At timepoint *t*0, meaning, directly at the exposure command, in the inventive X-ray diagnostic apparatus there is, however, effected a continual increase in the X-ray tube power output up to the value P3. The cycle or sequence of the X-ray tube power output between timepoints *t*0 and *t*1 is so selected whereby, at each timepoint, the X-ray tube power output has the highest permissible value for the respective anode rotational speed, or a predetermined percentage portion thereof. The power value P3 is thereby forced to lie somewhat below the power value P2, and the exposure time is longer than the exposure time by means of an X-ray diagnostic apparatus which is operated in accordance with FIG. 2. The time interval between the timepoint *t*0 and the deactivating timepoint, however, is substantially shorter in the inventive X-ray diagnostic apparatus than in the state of the technology, and a target which is selected by a physician for filming is essentially much better encompassed through the inventive power control arrangement as compared to the known X-ray diagnostic apparatus.

Figure 4:
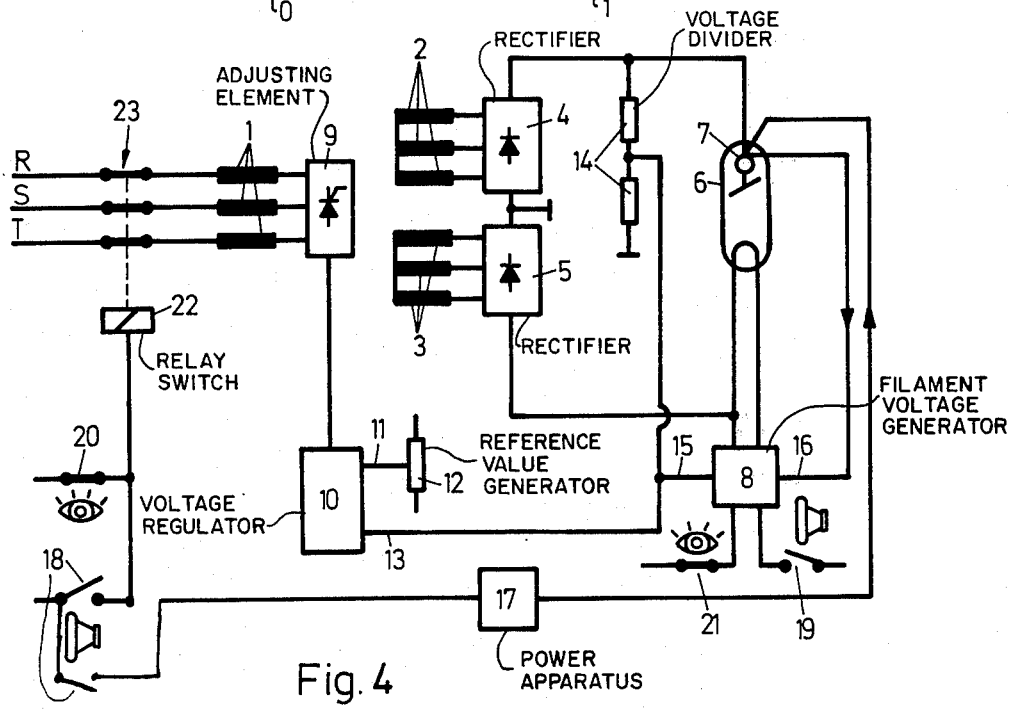
FIG. 4 is a schematic circuit block diagram of an X-ray diagnostic apparatus according to the invention.

The X-ray diagnostic apparatus described in FIG. 4 possesses a three-phase current-high voltage transformer which has a primary winding group 1 and two secondary winding groups 2 and 3, which supply two high voltage rectifiers 4 and 5 located in series with each other. The connective conduit of the high voltage rectifiers 4 and 5 are grounded. Connected to the high voltage rectifiers 4 and 5 is an X-ray tube 6 which has a rotating anode, whose rotating anode drive motor is schematically illustrated and designated by reference numeral 7. In order to generate the filament voltage by the X-ray tube 6 there is provided a filament-voltage generator 8. The X-ray tube voltage is determined by an adjusting element 9 having ignition characteristics, whose sensing ratio corresponds to the X-ray tube voltage. The adjusting element 9 is controlled by means of a voltage regulator 10 which possesses a reference value input 11 to which there is applied a signal from a reference value generator 12, which represents the reference value of the X-ray tube voltage. To the actual value input 13 of the voltage regulator 10 there is applied a signal which is tapped off from a voltage divider 14 and which represents the actual value of the X-ray tube voltage.

The filament-voltage generator 8 has applied to the input 15 thereof a signal corresponding to the actual value of the X-ray tube voltage, and the input 16 receives a signal corresponding to the actual value of the rotating speed of the anode. The last-mentioned signal may be delivered, for example, from a tachometer-generator which is connected to the rotating anode, or from an illuminative-electric converter. The powering of the rotating anode drive motor 7 is effected through a power apparatus 17 which is controllable from an exposure triggering element, and which includes two switches 18 and 19. During radioscopic operation the radioscopy switches 20 and 21 are closed.

The illustrated X-ray diagnostic apparatus is shown in its radioscopically operating condition. During a radioscopic examination, as well as during a film exposure, a relay switch 22 closes its contacts 23 and connects the primary winding 1 of the high voltage transformer to the alternating current power supply grid.

The radioscopic operation is carried out at an X-ray tube voltage which is adjusted at the reference value generator 12, and at an X-ray tube current which is fixedly programmed in the filament-voltage generator 8 and selected through the radioscopy switch 21. If transition is to be effected from radioscopic operation to a film exposure, then the radioscopy switches 20 and 21 are opened, and the exposure switches 18 and 19 are closed. The switch 18 applies a voltage to the power apparatus 17 for the rotating anode drive motor 7, so that the rotating anode accelerates, or may be speeded up from a basic rotational speed (16⅔ Hz) up to 150 Hz. The cycle of the X-ray tube power output in dependence upon anode rotational speed is fixedly programmed in the filament-voltage generator 8, and this program is selected from closure of the switch 19. Through the use of a calculator, the filament-voltage generator 8 compares the signals at its inputs 15 and 16, meaning, the actual value of the X-ray tube voltage with the actual value of the anode rotational speed, and calculates and adjusts, in conformance with its internally stored program, the particular associated X-ray tube current by means of the filament current. The X-ray tube power output, at timepoint *t*0 wherein the switches 20 and 21 are opened and the switches 18 and 19 closed, runs in accordance with the sequence shown in FIG. 3 until timepoint *t*1. At timepoint *t*1 there then follows the reduction of the X-ray tube power output in a known manner (dropping load according to FIG. 2). Within the scope of the invention there may also be effected continued operation at a constant X-ray tube load from timepoint *t*1 on, when the power P3 is correspondingly selected. The reduction in the X-ray tube output from timepoint *t*1 on, naturally, may no longer be carried out on the basis of the signal at inputs 15 and 16, since, commencing from timepoint *t*1, the anode rotational speed remains constant. Thus, it must be specially programmed into the filament-voltage generator 8.

In the X-ray diagnostic apparatus according to FIG. 1, the radioscopic voltage may be equal to the exposure voltage. The increase in the X-ray tube power output results automatically through the increase in the X-ray tube current by means of the filament-voltage generator 8. Within the scope of the invention there may, however, also follow a change in the X-ray tube voltage and in the X-ray tube current upon transition of a radioscopic operation to an exposure. It is essential for the invention that each exposure upon actuation of the exposure triggering element immediately follow the preceding radioscopic sequence, and that the X-ray tube power output be increased in dependence upon the anode rotational speed pursuant to a preprogrammed cycle.

Figure 5:
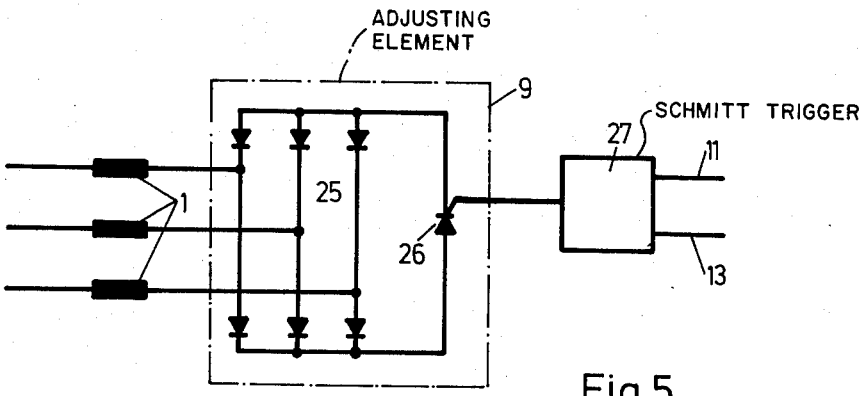
FIGS. 5 through 8, respectively, relate to various details of the X-ray diagnostic apparatus of FIG. 4.
Figure 6:
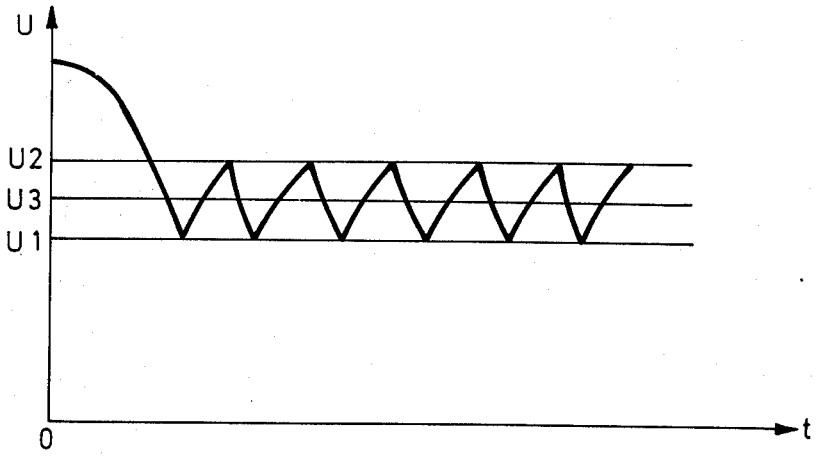

FIG. 5 in greater detail illustrates the construction of the adjusting element 9. The adjusting element 9 includes a polyphase current-rectifier bridge 25, and having a thyristor 26 located in the direct-current branch thereof. The ignition electrode of the thyristor 26 is connected to the output of a Schmitt-trigger 27, the latter of whose two inputs are the inputs 11 and 13 shown in FIG. 4 of the drawings. Through the signal at the input 11, there is determined the switching threshold of the Schmitt-trigger 27. The Schmitt-trigger 27 reverses when the signal at input 13 reaches this switching threshold. In FIG. 6 of the drawing, these relationships are set forth in closer detail.

FIG. 6 has the basic assumption imparted thereto that at time point 0 the high voltage generator is placed into operation. At time point 0, the X-ray tube voltage is still 0 and the thyristor 26 is ignited. The voltage U at the thyristor drops down to the value U1. Upon reaching the voltage U1 at the thyristor 26, which correponds to a predetermined X-ray tube voltage, the input voltage at input 13 exceeds the threshold which is determined by the voltage at the input 11, and the Schmitt-trigger 27 reverses and, thereby deactivates the thyristor 26. The voltage at thyristor 26 once again increases and, namely, up to value U2. Upon reaching this value, the thyristor 26 is again ignited so that its voltage gain drops off until it reaches the value U1. Thus, the voltage at thyristor 26 oscillates back and forth between the values U1 and U2. The voltage at the X-ray tube 6 varies in conformance therewith. The voltages U1 and U2 correspond to the hysterises of the Schmitt-trigger 27 and, consequently, deviate only to a small extent from the voltage U3, the latter of which corresponds to the reference value of the X-ray tube voltage and lies between the voltages U1 and U2.

Figure 7:
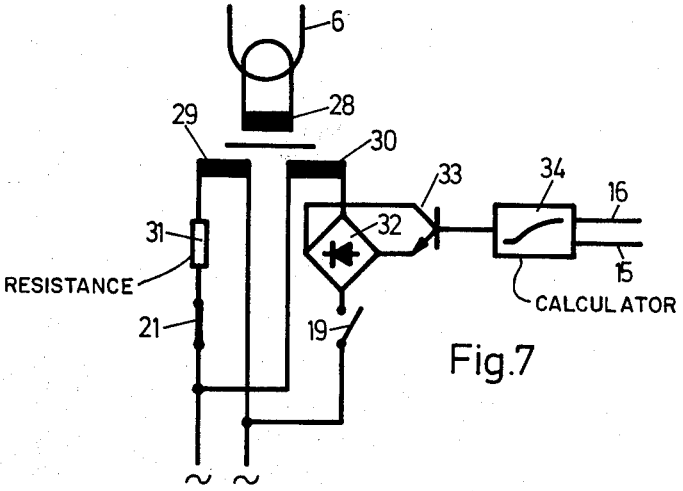

FIG. 7 illustrates the construction of the filament-voltage generator 8. The filament-voltage generator includes a filament transformer which has a secondary winding 28 and two primary windings 29 and 30. During radioscopic operation, meaning with closed switch 21, the primary winding 29 is connected across a series resistance 31 and the radioscopy switch 21 to the power supply grid. The series resistance 31 determines the constant radioscopic filament current of the X-ray tube 6 and, consequently, also the radioscopic X-ray tube current.

For producing an exposure, as described, the radioscopy switch 21 is opened, and the exposure switch 19 is closed. Thereby, the primary winding 30 is connected to the power supply grid across a diode bridge 32, in whose direct-current branch there is located a transistor 33 which forms variable resistance. The resistance of the transistor 33 determines the filament current and thereby the X-ray tube current. The diode bridge 32 is accordingly employed so that the two half-waves of the primary current can flow through the transistor 33. The resistance of the transistor 33 is determined by means of a calculator 34, to which there is transmitted a signal corresponding to the X-ray tube voltage through conduit 15, and through conduit 16 a signal corresponding to the anode rotational speed. The calculator 34 may be, principally, a function generator, as shown and described with reference to FIGS. 12.23 and 12.25 of Modern Operational Circuit Design; John I. Smith; Wiley-Interscience Division of John Wiley & Sons, Inc.; New York, 1971; pages 164 to 171. Basically, calculator 34 is a switch element wherein the output signal, which is transmitted to the diode bridge 32, depends upon the input signals on the inputs 15 and 16 pursuant to a predetermined function. In the calculator 34 there is stored the curve between the timepoints t0 and t1, according to FIG. 3. For each anode rotational speed there are provided a predetermined X-ray tube power output. Since the calculator receives a signal embodying the X-ray tube voltage, it can calculate for the X-ray tube current required for this power, and thereby the filament current, and to thereby adjust the resistance of the transistor 33, so as to set this calculated X-ray tube current. At timepoint t1, meaning in effect, when the maximum rotational speed of the anode in the X-ray tube 6 has been reached, the calculator 34 effects the control of the X-ray tube power output independently of the signal in the conduit 16, in conformance with the desired operating sequence. For example, from timepoint t1 on, as shown in FIGS. 2 and 3, the X-ray tube power output may be reduced in conformance with the cycle or sequence of the highest permissible value.

Figure 8:
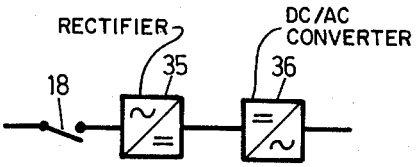

FIG. 8 illustrates the construction of the power apparatus 17 for the rotating anode drive motor. The power apparatus, in the illustrated example, consists of a rectifier 35 and a dc-ac converter 36, which powers the rotating anode drive motor and whose output frequency is higher than the power supply grid frequency. Within the scope of the invention it is also possible to employ two dc-ac converters, of which one powers the rotating anode drive motor during radioscopic operation at a lower power frequency, and the other powers the rotating anode drive motor during an exposure at a higher power grid frequency.

While there has been shown what is considered to be the preferred embodiment of the invention, it will be obvious that modifications may be made which come within the scope of the disclosure of the specification.

What is claimed is:

1. In an X-ray diagnostic apparatus for radioscopy and film exposures; including an X-ray tube having a rotating anode; and power adjusting means adapted to increase the X-ray tube power output during transition of said apparatus from radioscopic operation to film exposures, the improvement comprising; exposure switch means for initiating each exposure immediately subsequently to a preceding radioscopic examination; and means for transmitting a signal representative of the actual value of the anode speed of rotation to said power adjusting means, said power adjusting means being programmed in conformance with the permissible sequence of the X-ray tube power output and being adapted to effect the adjustment of the X-ray tube power output associated with the respective anode speed of rotation.

2. An X-ray diagnostic apparatus as claimed in claim 1, comprising a calculator in said power adjusting means, said calculator receiving signals representative of the actual values of the X-ray tube voltage and anode speed of rotation for indicating and adjusting the respectively permissible X-ray tube current.

3. An X-ray diagnostic apparatus as claimed in claim 2, the radioscopic X-ray tube voltage of said apparatus being equal to the exposure X-ray tube voltage; and control means for maintaining constant said voltage.

* * * * *